US007034791B1

(12) United States Patent
Odom

(10) Patent No.: US 7,034,791 B1
(45) Date of Patent: Apr. 25, 2006

(54) DIGITAL VIDEO DISPLAY EMPLOYING MINIMAL VISUAL CONVEYANCE

(76) Inventor: Gary Odom, 15505 SW. Bulrush La., Tigard, OR (US) 97223

( * ) Notice: Subject to any disclaimer, the term of this patent is extended or adjusted under 35 U.S.C. 154(b) by 283 days.

(21) Appl. No.: 09/908,166

(22) Filed: Jul. 18, 2001

Related U.S. Application Data

(63) Continuation-in-part of application No. 09/736,938, filed on Dec. 14, 2000, now abandoned.

(51) Int. Cl.
*G09G 3/36* (2006.01)

(52) U.S. Cl. ..... 345/98; 345/694; 345/97; 345/99; 345/100

(58) Field of Classification Search ..... 345/501–506, 345/519–520, 530, 574, 694–698, 55, 581, 345/790, 619, 87–105; 348/588, 600
See application file for complete search history.

(56) References Cited

U.S. PATENT DOCUMENTS 4,587,559 A * 5/1986 Longacre et al. ..... 348/718
4,658,247 A * 4/1987 Gharachorloo ..... 345/560
4,878,183 A * 10/1989 Ewart ..... 345/428
5,321,419 A * 6/1994 Katakura et al. ..... 345/97
5,321,809 A * 6/1994 Aranda ..... 345/570
5,345,250 A * 9/1994 Inoue et al. ..... 345/100
5,345,552 A * 9/1994 Brown ..... 345/784
5,453,790 A * 9/1995 Vermeulen et al. .... 375/240.12
5,801,785 A * 9/1998 Crump et al. ..... 348/563
5,815,131 A * 9/1998 Taniguchi et al. ..... 345/94
5,838,291 A * 11/1998 Ohshima et al. ..... 345/97
5,933,148 A * 8/1999 Oka et al. ..... 345/427
5,945,972 A * 8/1999 Okumura et al. ..... 345/98
5,959,639 A * 9/1999 Wada ..... 345/542
6,052,492 A * 4/2000 Bruckhaus ..... 382/284
6,057,824 A * 5/2000 Katakura et al. ..... 345/100
6,091,389 A * 7/2000 Maeda et al. ..... 345/98
6,097,364 A * 8/2000 Miyamoto et al. ..... 345/97
6,266,716 B1 * 7/2001 Wilson et al. ..... 710/33
6,271,867 B1 * 8/2001 Moriarty ..... 345/545
6,289,299 B1 * 9/2001 Daniel et al. ..... 703/21
6,295,503 B1 * 9/2001 Inoue et al. ..... 701/209
6,321,209 B1 * 11/2001 Pasquali ..... 705/14
6,332,003 B1 * 12/2001 Matsuura et al. ..... 375/240.23
6,339,417 B1 * 1/2002 Quanrud ..... 345/98
6,421,571 B1 * 7/2002 Spriggs et al. ..... 700/17
6,421,606 B1 * 7/2002 Asai et al. ..... 701/209
6,456,335 B1 * 9/2002 Miura et al. ..... 348/588
6,531,997 B1 3/2003 Gates
6,542,815 B1 * 4/2003 Ishizaki et al. ..... 701/209
6,546,188 B1 * 4/2003 Ishii et al. ..... 386/52

(Continued)

OTHER PUBLICATIONS

C.W. Tang and S.A. Vanslyke, Organic electroluminescent diodes, Applied Physics Letter, Sep. 21, 1987, pp. 913-915, vol. 51, No. 12, USA.

(Continued)

*Primary Examiner*—Jeffery Brier
*Assistant Examiner*—J. Amini

(57) ABSTRACT

Select areas and specific pixels of a digital video display screen may be updated at video frame rate while other areas or pixels are not updated at video frame rate. Further, select pixels may be updated more than once within the normal update timing of a single video frame. Selective updating may be accomplished by indicating data video processing requirements.

17 Claims, 7 Drawing Sheets

U.S. PATENT DOCUMENTS

| | | | | |
|---|---|---|---|---|
| 6,628,299 | B1 * | 9/2003 | Kitayama | 345/635 |
| 6,642,069 | B1 | 11/2003 | Armgarth | |
| 6,704,803 | B1 * | 3/2004 | Wilson et al. | 719/315 |
| 6,851,091 | B1 * | 2/2005 | Honda et al. | 715/721 |
| 2001/0052903 | A1 * | 12/2001 | Katsura et al. | 345/552 |
| 2002/0012010 | A1 * | 1/2002 | Pasquali | 345/719 |

OTHER PUBLICATIONS

Gail Robinson, IC effort envisions wall-sized circuits, Electronic Engineering Times, Mar. 31, 1997, pp. 1-2, USA.

"Lightening up", The Economist magazine, Jun. 2, 2001, pp. 82-83.

* cited by examiner

| | |
|---|---|
| 27A TEXT | 24A VIDEO |
| 25A PHOTO | 26A GRAPHIC |

| | |
|---|---|
| 27B TEXT | 25B PHOTO |
| 27C TEXT | 24B VIDEO |

DIGITAL VIDEO DISPLAY EMPLOYING MINIMAL VISUAL CONVEYANCE

REFERENCE

This application is a continuation-in-part of application Ser. No. 09/736,938, filed Dec. 14, 2000, and abandoned in favor of this application.

TECHNICAL FIELD

This is about digital video displays employing minimal visual conveyance.

BACKGROUND

Video displays have historically updated all picture elements (pixels) of a display frame by frame employing raster scanning, whereby all display pixels are updated and refreshed in one (progressive) or two (interleave) passes at a frame rate sufficient to maintain the realistic illusion of movement that video is designed to convey. A composite frame of multiple images has to have been composed prior to transmission to the display: a single full frame is transmitted to the display each scan update. For example, picture-in-picture analog television display was accomplished by overlaying multiple video image frame buffers into a single frame buffer, and then that single frame transmitted and displayed on a raster-scanned video display.

Historically, video transmission as well consisted of successive full frames. As a means to compress data for transmission, recently developed video formats such as MPEG use partial frames, though those partial frames are transposed into full frames prior to display on the target device, as the display device itself is designed exclusively for full frame updating.

The 1999 second edition of "DTV, The Revolution in Digital Video" by Jerry Whitaker characterizes current television technology (page 376): "The cathode-ray tube (CRT) has remained the primary display device for television since electronic television was developed in the 1930s. It survived the conversion from monochrome to color television, but it may not survive the cessation of analog television broadcasting. The CRT is fundamentally a 3-dimensional structure and, as such, is limited in the size of image available on direct-view tubes . . . . Although project displays can provide extremely large images, they too are 3-dimensional boxes, which in many homes are simply unacceptably large.

"It is undeniable that great progress has been made in solid state displays of various designs over the past few years . . . . While promising new products continue to be developed with each passing year, the hang-it-on-the-wall display is still (at this writing) perhaps five years away. Having said that, it is only fair to point out that such devices have been about five years away for the past thirty years."

The Dec. 9, 2000 Economist magazine wrote of the portents of change in digital display technology: "Kent Displays is working on "cholesteric" liquid crystals—so-called because the liquid-crystal material is made from cholesterol. The cholesteric-LCD is chemically altered so that it is bi-stable, being reflective or non-reflective depending on the direction of the electric current applied to its surface.

"Ingeniously, Kent makes three versions of the display, which can reflect red, blue or green light—the primary colors from which all others are composed. By stacking the three versions as a sandwich, the company can produce a highly reflective 4,000-colour display with a contrast ratio as good as ink on paper . . . . As it can be switched from reflective to non-reflective in a brisk 30 milliseconds, Kent's colour display can also show videos . . . .

"Although getting better all the time, display technology—and the related constraint of battery life—has been a limiting factor in the development of portable consumer electronics. That is because existing displays have to be refreshed continuously. Researchers reckon that, all things being equal, bi-stable displays consume less than a hundredth of the power used in refreshed displays. That could translate into either much smaller batteries or a much longer period between charges."

Another article in the Jun. 2, 2001 Economist magazine touts the imminent commercialization of displays based upon optical light-emitting diode (OLED) technology: "Barry Young of DisplaySearch, a market-research firm based in Austin, Tex., claims that 30 firms have announced plans to produce OLED displays . . . .

"Since the current controlling an OLED can rapidly be "toggled" on and off, individual picture elements (pixels) on a screen can change their appearance fast enough to handle a stream of video or web images without leaving irritating after-images on the screen."

Recent advances in display technology suggest commercially viable high resolution digital video displays are forthcoming. As new digital display device technology fundamentally differs from its historical antecedents, display resolution and size, power consumption, and other cost and performance related considerations suggest an alternative to conventional raster scanning technology.

SUMMARY

Minimal visual conveyance has the potential of minimizing power consumption and life-cycle cost for emerging display technologies while allowing enhanced performance for displays offering vastly improved resolution. Minimal visual conveyance creates new opportunities for data expression and compression.

BRIEF DESCRIPTION OF THE DRAWINGS

FIG. 6 depicts a portioned display.

DETAILED DESCRIPTION

Figure 1:
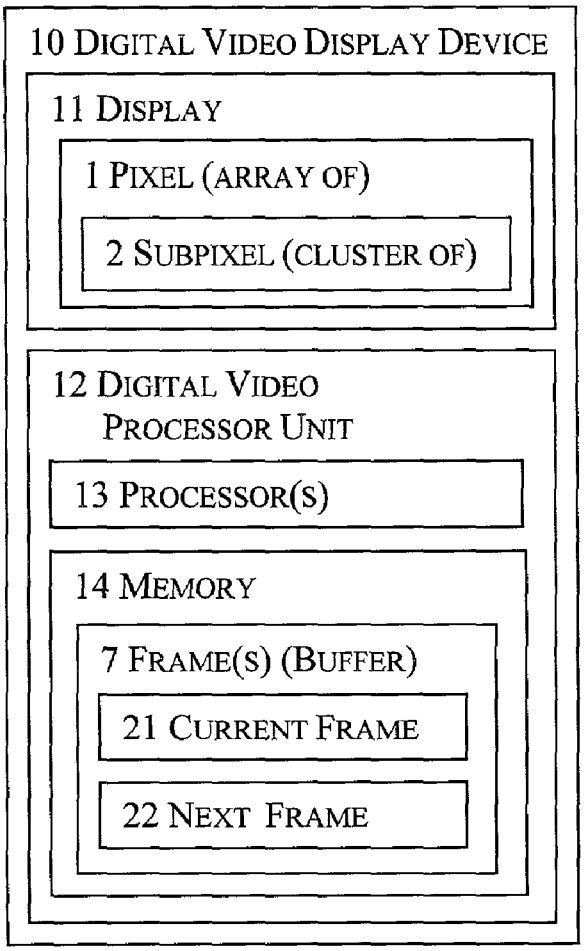
FIG. 1 is a diagram of a digital video display device.

FIG. 1 is a diagram of a digital video display device 10 comprising a display 11 and a digital video processor unit 12. An array of digitally addressable picture elements (pixels) 1 comprise the display 11. The display 11 pixels 1 preferably create a color image, but may suffice producing black-and-white, gray-scale, or other contrast or gradient image. A pixel 1 may be comprised of a subpixel 2 cluster:

in some display devices, red 16, green 17 and blue 18 subpixels 2 comprise a color pixel 1.

Pixels 1 for a digital video display 11 may be stable, not requiring frequent refresh. For displays 11 with pixels 3 requiring refreshing, such as, for example, active matrix LCD displays 11 powered with the assist of capacitors, refresh may be distinguished from pixel 1 updating, analogous to computer dynamic memories, where the synchronicity of refresh and update belie their opposite functions: maintaining bit status versus altering bit status.

A digital video processor unit 12 comprises one or more processors 13 and memory 14 which can be employed to respectively process and store successive image frames 7 for display. At least a portion of memory 14 may comprise at least two frame buffers 7: one frame buffer 7 is the current frame 21; another, a next frame 22 for display. If the pixels 1 of the display 11 itself can be read as well as written to, the display 11 itself may be the current frame 21. Multiple processors 13 and additional frame buffers 7 may be employed to accelerate processing or to otherwise facilitate display 11 updating 30.

Processing circuitry and firmware for frame reception and conventional frame display are known to those skilled in the art, so are not be described herein. Likewise, knowledge of digital video graphics composition and editing technologies are presumed. The nomenclature of comparing pixels 1 or subpixels 2 is understood to mean, as those skilled in the art would have assumed, comparing the values of representations of pixels 1 or subpixels 2 respectively.

Figure 2:
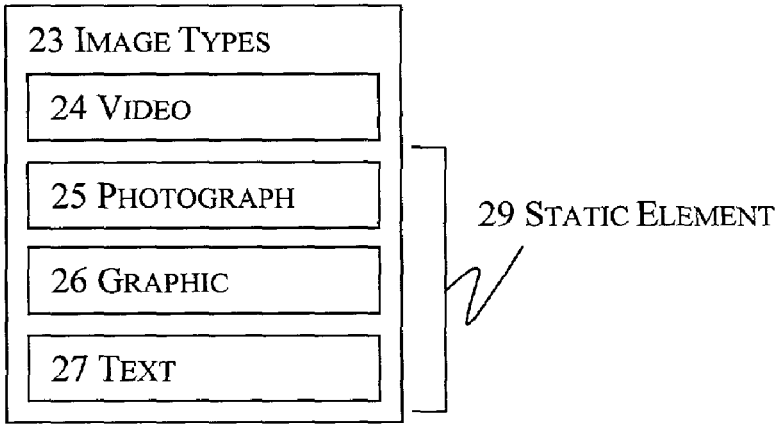
FIG. 2 is a diagram of image types.

FIG. 2 depicts exemplary image types 23, including video 24 and relatively static elements 29 (compared to video). Video 24 comprises successive images conveying a realistic illusion of movement. Static elements 29 are visual expressions exclusive of but possibly incorporated into video 24, examples of which include photographs 25, graphics 26 (including possibly computer software controls), and text 27. The data formats for different image types 23 may identify each type at least with regard to update 30 requirements.

Figure 3:
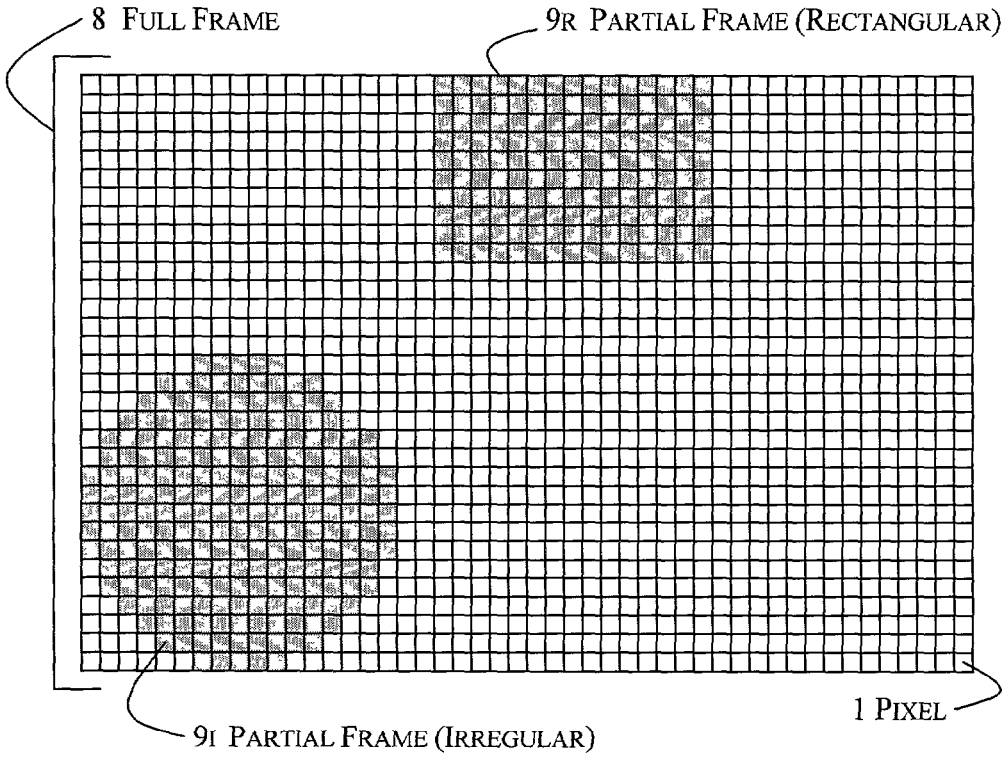
FIG. 3 depicts frames.

A frame 22 may be a full frame 8 or a partial frame 9, as depicted in FIG. 3. A partial frame 9 may be rectangular 9*r* or irregular 9*i* in shape. Irregular shape includes any non-rectangular shape. Irregular shape frames 9*i* may be achieved employing known digital image processing masking techniques.

In FIG. 3, considering what appears on the display 11 as a full frame 8, a portion of the display (9*r* for example) may be designated for displaying a specific video 24, with other portions 9 of the display 11 designated to displaying other image information of various types 23. This is somewhat analogous to picture-in-picture television display, but, whereas in conventional television a single display frame may be a composite of multiple frame buffers, and all pixels of the display are updated with a single frame each scan, the digital video display 11 described becomes equivalently comprised of multiple frame buffers 7 which may be updated asynchronously as required. In other words, in conventional picture-in-picture analog television, what appears to be multiple asynchronous video display is in fact synchronous display updating due to the scanning mechanism employed for full display refresh, whereas in displaying multiple image information with at least one video 24 display on a digital video display 11 as described, display and update 30 of each perceived image element (such as a video 24 as one element and a photograph 25 as another element, for example) may be asynchronous (independent).

Figure 4:
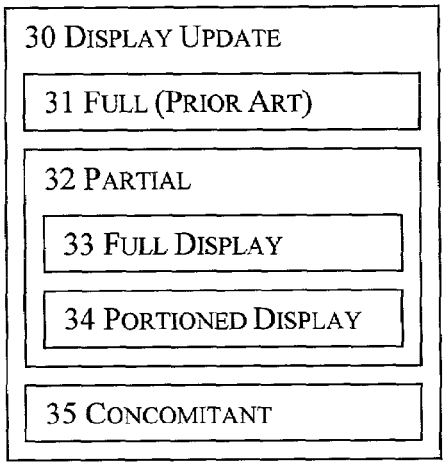
FIG. 4 depicts display update from a frame orientation.

FIG. 4 depicts video display frame update 30 technologies: full 31, the historical antecedent, and partial 32, the technology largely described herein. Partial updating 32 may be applied to the full display 33, or to portions of the display 34 synchronously or asynchronously.

Figure 5:
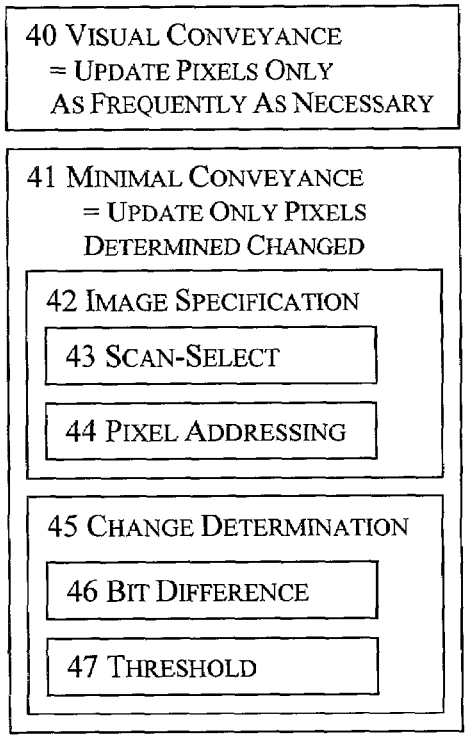
FIG. 5 depicts display updating technologies.

FIG. 5 depicts display updating 30. Visual conveyance 40 is updating the pixels 1 of a full 8 or partial 9 frame 7 only as frequently as necessary. Video 24, for example, must nominally have visual conveyance 40 equivalent to sufficient frame rate 28 to maintain the realistic illusion of movement that video 24 can convey. So, for a video 24, visual conveyance nominally equates to video frame rate 28. Prior art video display is visual conveyance 40 of all pixels of the entire display at frame rate.

Another example of visual conveyance 40: on a computer display 11 using portioned display 34, the appearance of a displayed software control (likely a graphic 26 image) must change quickly enough when manipulated by a user to demonstrate responsiveness to such user manipulation. That required quickness of responsive change in appearance is the visual conveyance for the frame 7 displaying such a control. Minimal conveyance 41 is updating the fewest pixels 1 in the necessary timeframe to maintain the desired visual effect. In the software control example, minimal conveyance 41 is updating only the pixels 1 responsible for control highlighting, depicting selection or deselection as necessary.

Figures 6A, 6B, 7:
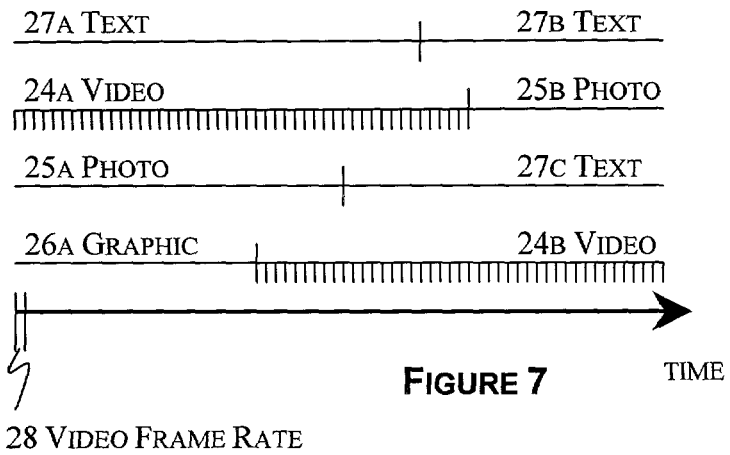
FIG. 7 depicts update of a portioned display through time.

FIGS. 6 and 7 illustrate more explicitly by example compositional (portioned) display 34 and visual conveyance 40. A display 11 is partitioned 34 with different frames 7, as depicted in FIG. 6*a*. The location of each partial frame 9 may be specified, for example, by an offset from a corner of the display 11, with specific bounds for the frame 9. Likewise, elements 23 to be displayed within a frame 7 may also be specified by an offset from a location (typically the top-left corner) of the display 11. In FIG. 6*a*, a video 24*a* in the upper right plays while static elements 29 are displayed elsewhere. For a display device 10 attached to a computer or other interactive device, a graphic 26*a* may include an interactive control, as in the aforementioned example. The pixels 1 of a partial frame 9 comprising a video 24*a* require updating at the necessary frame rate 28 to maintain the realistic illusion of movement that video 24 can convey. Contrastingly, a displayed static element 29 typically does not need updating. Once displayed, for example, the pixels 1 displaying a photograph 25*a* do not require updating until the photograph 25*a* is replaced. The photograph 25*a* in FIG. 6*a* is replaced by text 27*c* in FIG. 6*b*.

FIG. 7 depicts frame update 34 timing by showing tic marks for each frame 9 update. As depicted, the portion 9 of the display 11 displaying video is constantly updated, while static elements 29 are not.

A portioned display 34 may be transitioned to different frames 9 of different image types 23 at different times, as the example of FIGS. 6 and 7 shows. Though not depicted, frame 9 configurations may dynamically change. The pixels 1 of frames 22 need be updated only as required for visual conveyance 40.

A portioned display update 34 may occur in only a portion 9 of the display 11, as previously described, and even within that portion, employing minimal conveyance 41, only a portion of those pixels 1 in a frame 7 potentially updated may be actually updated. Multiple updates of different partial frames 9 of a display 11 may occur concurrently.

Figure 8:
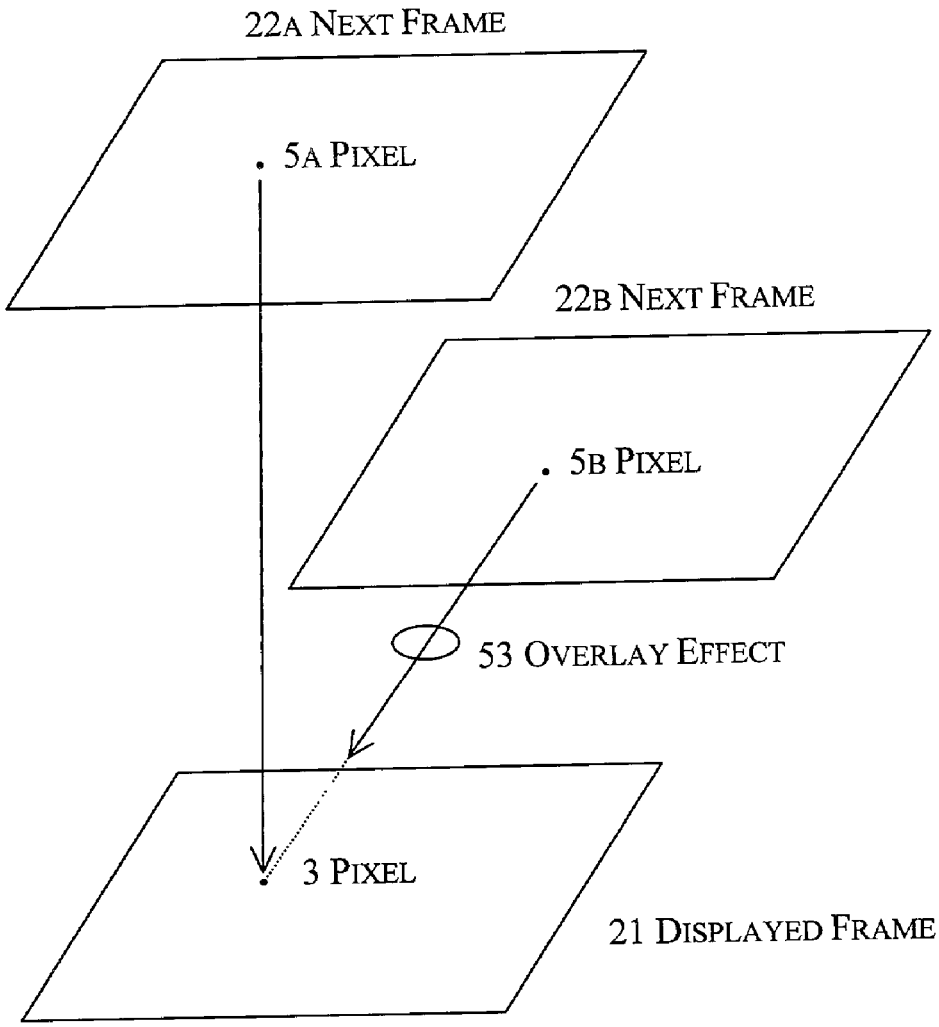
FIG. 8 depicts concomitant updating.

Concomitant updating 35 is a visual conveyance 40 process whereby individual pixels 1 of a frame 7 are multiply updated in the time frame of what otherwise would be a single frame 7 display (appropriate frame rate 28 for the image type 23). A concomitant update 35 may occur in the full 8 or partial 9 frame. FIG. 8 illustrates an example: a pixel 3 in a currently displayed frame 21 is set to correspond to a pixel 5*a* from a first next frame 22*a*, then that pixel 5*a* altered to account for an overly effect 53 from a corresponding pixel 5*b* from another next frame 22*b* prior to completing update 30 of the current frame 21 to the next frame 22. Without an overlay effect 53 that achieves a degree of translucency, the last applied pixel 5*b* would simply overwrite the first 5*a*.

A visual effect employing concomitant updating 35 may be created programmatically (algorithmically) as well as through frame 22 overlay 53 as described above. The illusion of fog, haze, or rain could be conveyed algorithmically using an overlay effect 53.

Concomitant updating 35 may be employed to create special visual effects achieved in the prior art using composite frames. In essence, prior art video and graphic effects rendered by applying multiple frame buffers and mask overlay techniques to create a composite frame can now be created via concomitant updating 35. Scrolling text 27, pop-up text 27, or closed captioning over a video 24, photograph 25 or graphic 26 are example applications of concomitant updating 35.

With minimal conveyance 41, updating 30 may be accomplished by one or both of the alternative methods of scan-select 43 or pixel addressing 44.

Current video formats implicitly require a scanning regime of the display. Employing scan-select 43, scanning applies to differential analysis between the frame currently displayed 21 and the next frame 22 to be displayed, not the display 11 itself. With pixel addressing 44, individual pixels 1 or regions 9 of pixels 1 are specified for updating 30.

Video has been historically displayed frame by frame. With pixel addressing 44, an image may be created on a display 11 without necessarily creating a frame 7 prior to display.

Pixel addressing 44 differs from scan-select 43 in preprocessing. On the one hand, scan-select 43 best applies to frames 7 where an unknown proportion of pixels have changed. On the other hand, pixel addressing best applies to partial frames 9 (regardless of shape, but often irregular 9*i*) which may be optimized such that many if not most pixels 1 in the next frame 22 have changed.

Scan-select 43 and pixel addressing 44 should be viewed as complementary, not mutually exclusive. For example, pixel addressing 44 may be less efficient for continuous full frame update 33, but may be a valuable method for certain types 23 of compressed display data.

Employing change determination 45, only pixels 1 or subpixels 2 determined to have changed are updated. In some embodiments, a current pixel 3 is compared to a corresponding (in the same display location) next pixel 5. In embodiments employing one or more frames 7 to create the next displayed frame 22, the two corresponding pixels are the next pixel 5 is of the next frame 22 and the current pixel 3 of the current frame 21. For displays 11 with composite pixels 1, such as color liquid-crystal displays 11, where multiple subpixels 2 (red 16, green 17, blue 18) comprise a single picture element 1, comparison may be at the pixel 1 or pixel component 15 level. If comparing pixel components 15, only subpixels 2 determined to have changed are updated as required. In embodiments employing a next frame 22, the methods for minimal conveyance 41 described apply regardless whether the next frame 22 is a full frame 8 or a partial frame 9: only those pixels 1 or subpixels 2 determined to have changed are updated.

Figure 9:
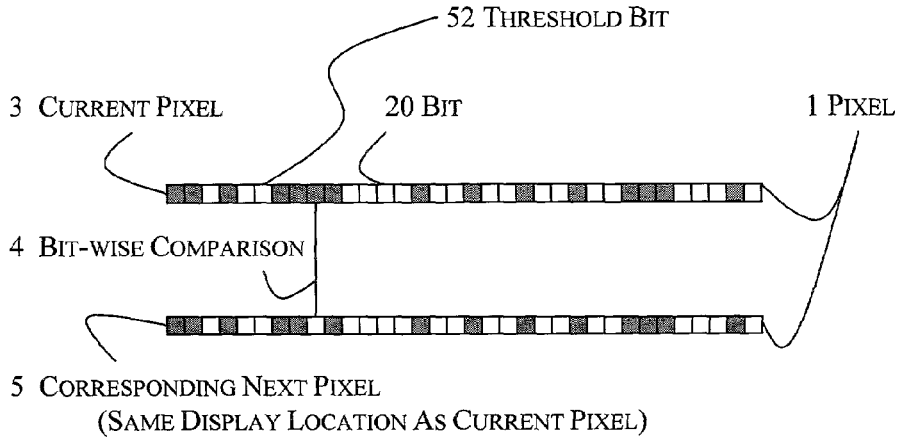
FIG. 9 depicts bit-wise comparison of pixels between the current and next frame.

Employing bit-wise determination 46 to implement partial updating 41: a next pixel 5 (or subpixel 2) is bit-wise compared 4 to its corresponding current pixel 3 (or subpixel 2). Any changed bit 2 in a pixel 1 (or subpixel 2) is a determination of change 45 that results in updating that pixel 3 (or subpixel 2). A predetermined threshold bit 52 may be employed to mask less significant bits from consideration of bit-wise change determination 46. Employing a threshold bit 52 in effect creates a threshold basis for pixel 1 (or subpixel 2) update determination 45. An example of bit-wise determination 46 for pixels 1 is depicted in FIG. 9.

Employing threshold determination 47 to implement minimal conveyance 41 in an embodiment with a display 11 comprising subpixels 2, for example: each component 36 of each corresponding next pixel 5 is compared 4 to its respective component 36 of the current pixel 3 to derive a component difference 15 which is compared to a difference threshold 51 to determine update necessity. A subpixel 2 may correspond to a pixel component 36: for example, there may be red, green and blue subpixels 2 that respectively equate to the red 16, green 17 and blue 18 components 36 of a pixel 1. In some embodiments, pixel components 36 may not correspond in whole or part to subpixels 2: luminance, for example, may be a component 36. In an alternate embodiment comparing pixels 1, a pixel difference 19 is used in lieu of component difference 15: essentially, comparing current 3 to corresponding next 5 pixel values rather than pixel component 36 (or subpixel 2) values. Method applicability depends upon display 11 technology and how pixel 1 data are encoded: whether the display 11 has subpixels 2, or a data format that permits efficient componentization. Employing threshold determination 47, a subpixel 2 or pixel 1 is determined to change when respectively a component difference 15 or pixel difference 19 exceeds a predetermined threshold 51.

Figure 10:
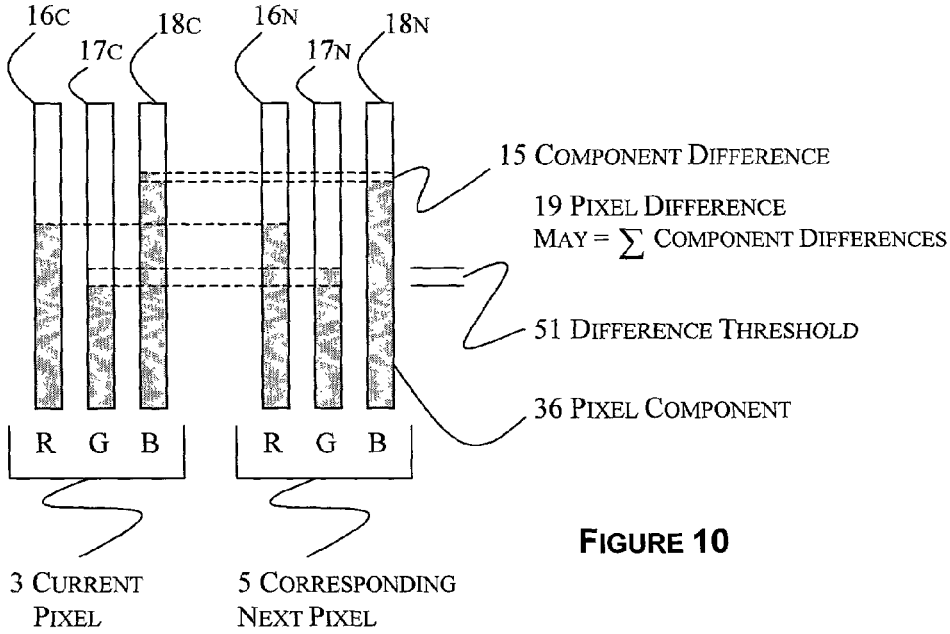
FIG. 10 depicts difference determination of pixels between the current and next frame.

An example of threshold determination 41, depicted in FIG. 10, illustrates a modest component difference 15 between the blue components (18*c*, 18*n*) of the same successive (next corresponding) pixel (a pixel of the current frame 3 compared to the next 5), and a more significant difference between the green components 17. A pixel difference 19 is the summation of component differences 15. A difference threshold 51 may be applied to component/subpixel difference 15 or to pixel difference 19. In the FIG. 10 example, the blue component difference 15 compared to difference threshold 51 would result in determination not to update a blue subpixel 2, but a green subpixel 2 would be updated, as its change 15 meets the threshold 51. Considered as a pixel 1, the pixel difference 19 exceeds the threshold 51, whereby updating would occur. For displays 11 with subpixels 2, the preferred embodiment is subpixel 2 updating 30 based upon a components 36 that correspond to subpixels 2 and comparing component differences 15 to a subpixel/component difference threshold 51.

Bit difference 46 and threshold 47 determination techniques are related: if the difference threshold 51 equals the threshold bit 52 of a pixel 1 or subpixel 2, the two techniques are equivalent.

Figure 11:
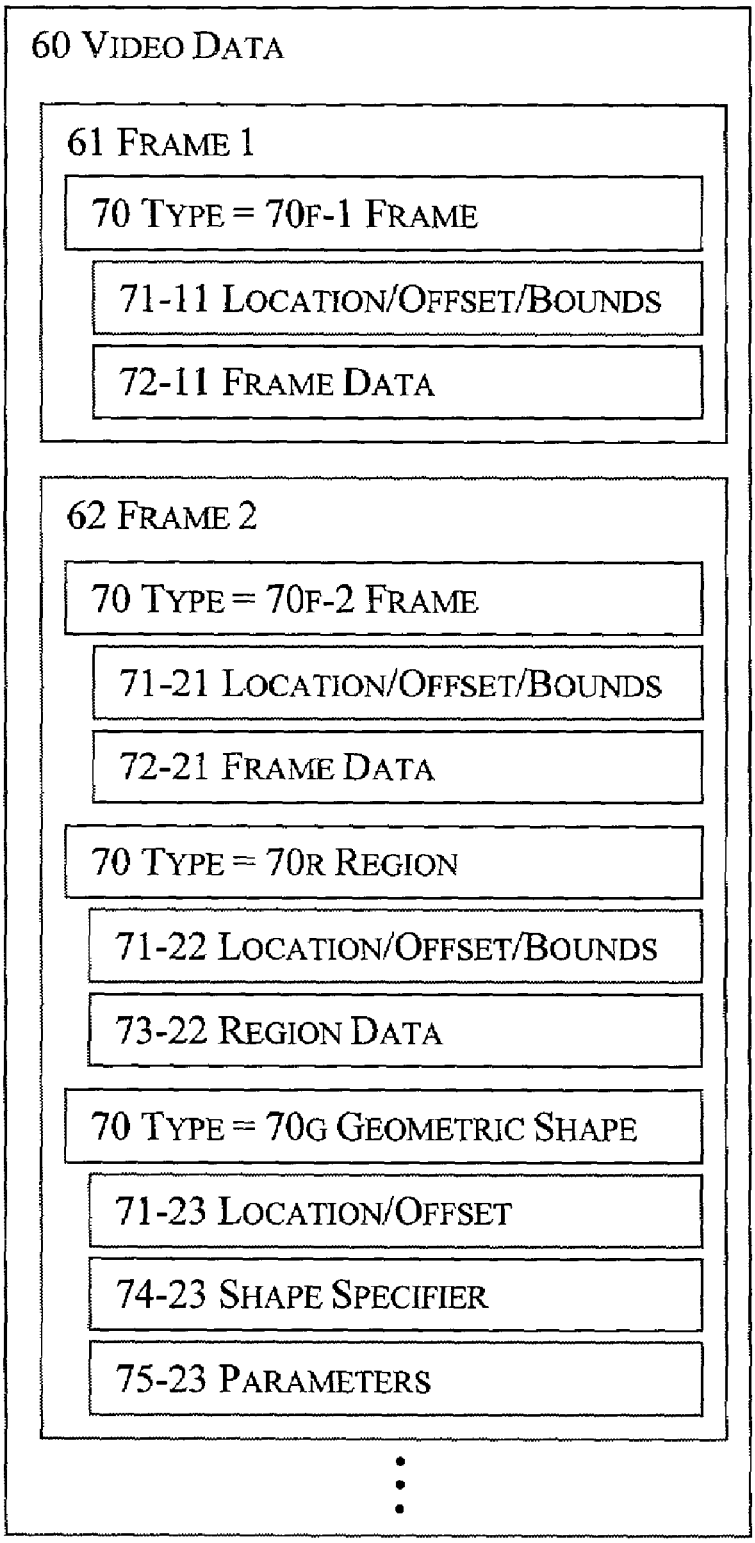
FIG. 11 depicts an example of video data.

New data formats for different image types 23 that take of advantage of minimal conveyance 41 offer enhanced efficiencies. FIG. 11 illustrates an example. The first frame 61 of a video 24 may be specified as a frame 70*f*-1. The second, next successive frame 61 may be constructed in whole or part from different data sources, such as a succeeding frame 70*f*-2; a specified region 70*r*, perhaps a sprite or explicitly addressed pixels 5; or a geometric shape 70*g*, possibly defined via parametric equation.

Scan-select 43 promises significant video data compression opportunities given preprocessing that identifies and stores frame-to-frame changed pixels 1. Image 23 data formats whereby pixel addressing 44 may be most economically employed may be largely algorithmic 70*g*: text and polygons via parametric equations are examples. Irregularly defined regions 9*i* known as sprites 70*r* are another example application for pixel addressing 44. Essentially, the optimal data format for minimal conveyance 41 is one that codifies image specification 42 with changed pixels 1 coupled to update 30 requirements; frame 7 specification 70*f* can be reduced to circumstances where such representation is optimally efficient, such as the first frame 61 of a video 24 sequence, or a photograph 25.

Pixel addressing 44 enhances performance by disintermediation of compositional frames 7 prior to display. Data formats and graphic techniques based upon relative display location have been employed with graphics software and prior art video games, for example, with the significant difference that with pixel addressing 44, data is immediately addressed to the display 11, not, as in the prior art, composed into frames that are then scanned on the display.

The invention claimed is:

1. A method for minimizing display screen updating in a display device comprising at least in part a display processing unit and a display screen, wherein said display screen comprises at least in part pixels capable of sustained image display without constant refreshing, said method comprising the following steps:

a display processing unit receiving for display a first data block designated for a first area of said display screen, wherein said first data block is not designated as comprising dynamic data requiring video frame rate updating;

receiving for display a second data block designated for a second area of said display screen, wherein said second data block designated by type as dynamic data comprising successive images requiring video frame rate updating;

displaying said first data block in said first area of said display screen;

displaying a first video image of said second data block in said second area of said display screen;

displaying at least one next successive image of said dynamic data at said video frame rate in said second area without updating said first area of said display screen.

2. The method according to claim 1, such that only updating a portion of the pixels in said second area when displaying at least one said next successive video image.

3. The method according to claim 1 with the following additional steps:

receiving for display a successive image of said dynamic data for said second area;

receiving for display a third data block designated for a third area of said display, wherein said third area at least in part overlaps said first area of said display screen;

displaying said third data block in said third area of said display screen;

displaying a successive image of said dynamic data at said video frame rate in said second area of said display screen.

4. The method according to claim 3, such that not updating all pixels in said first area when displaying said third data block.

5. The method according to claim 1, wherein displaying said first data block results in displaying text.

6. The method according to claim 1, wherein said first data block does not comprise text.

7. A method for minimizing display screen updating in a display device comprising at least in part a display processing unit and a display screen, wherein said display screen comprises at least in part pixels capable of sustained image display without constant refreshing, said method comprising the following steps:

a display processing unit receiving a plurality of data blocks for display on different specified areas of a display screen, wherein each said data block comprises at least in part type data indicating whether said data block is dynamic data requiring video frame rate updating;

displaying at least two said data blocks in different areas of said display screen, wherein at least one first data block is dynamic data;

repeatedly updating at least a portion of the pixels in at least one display area comprising dynamic data at video frame rate without updating at least one area of the screen displaying data not indicated as dynamic data.

8. The method according to claim 7, with the additional step of receiving and displaying at least one second block of different data in at least one area of said display screen while continuing updating at video frame rate said area designated by first data block.

9. The method according to claim 8, wherein said second data block is indicated as dynamic data.

10. The method according to claim 8, wherein said second data block is not dynamic data.

11. A method for minimizing display screen updating in a display device comprising at least in part a display processing unit and a display screen, wherein said display screen comprises at least in part pixels capable of sustained image display without constant refreshing, said method comprising the following steps:

a display processing unit receiving for display a first data block designated for a first area of a display screen, wherein said first data block comprises at least one image of dynamic data, wherein said dynamic data comprises a series of successive images requiring video frame rate updating;

receiving for display a second data block designated for a second area of said display screen, wherein said second area at least in part within said first area;

displaying said first data in said first area of said display screen;

displaying a series of successive images of said dynamic data at said video frame rate in said first area, whereby at least once updating only a portion of the pixels in said first area during transitional display from one image to the next successive image;

displaying said second data and at least once updating display of at least a portion of said second data when pixels of said second data are overwritten during display of at least one said successive image of said dynamic data.

12. The method according to claim 11, wherein displaying said second data block results in displaying text.

13. The method according to claim 11, wherein at least one pixel is altered more than once within the timing at video frame rate of a single frame.

14. The method according to claim 13, wherein the second mathematical value of said altered pixel is a mathematical derivative of the first value of said pixel.

15. A display device comprising:

a display screen comprising at least in part location-addressable pixels;

display screen pixels capable of sustained image display without constant refreshing;

a clock driven display processing unit;

said clock operating at a frequency for providing an display update interval to said display processing unit;

said display processing unit for receiving and displaying on said display screen a plurality of images by type, said type for specifying required update frequency, wherein said display processing unit, within a single clock-driven update interval, updates at most a portion of said display screen pixels by address location based upon typed image data, wherein said updated portion does not comprise all display screen pixels.

16. Said display device according to claim 15, wherein said display screen comprises over one million pixels.

17. A method for minimizing display screen updating in a display device comprising at least in part a clock-driven display processing unit and a display screen, wherein said clock operates at a frequency providing an display update interval to said display processing unit, and wherein said display screen comprises at least in part location-addressable pixels, said pixels capable of sustained image display without constant refreshing, said method comprising the following steps:

a display processing unit receiving for display a first data block of a first type designated for a first specified area of said display screen, wherein said first area excludes at least a second area of said display screen;

said display processing unit receiving for display a second data block of a second type different from said first data block, wherein said second data block is designated for said second area of said display screen;

said displaying processing unit displaying said first and second data blocks in a first display update interval;

said display processing unit receiving for display a third data block of said first type designated for said first specified area of said display screen;

said display processing unit updating in a second update interval said first specified area of said display screen with said third data block without updating said second area of said display screen.

* * * * *